United States Patent [19]

Harris et al.

[11] 4,062,475

[45] Dec. 13, 1977

[54] PRESSURIZED CONTAINER FOR TWO-PHASE SYSTEM

[75] Inventors: Robert G. Harris; James A. Monson, both of Racine, Wis.

[73] Assignee: S. C. Johnson & Son, Inc., Racine, Wis.

[21] Appl. No.: 571,673

[22] Filed: Apr. 25, 1975

[51] Int. Cl.[2] ..... B65D 35/28

[52] U.S. Cl. ..... 222/95; 222/192; 222/386.5; 239/323

[58] Field of Search ..... 239/323, 328; 222/94, 222/95, 136, 192, 386.5

[56] References Cited

U.S. PATENT DOCUMENTS

| | | | |
|---|---|---|---|
| 3,113,698 | 12/1963 | Abplanalp | 222/136 UX |
| 3,211,349 | 10/1965 | Prussin et al. | 222/402.18 |
| 3,245,582 | 4/1966 | Roth et al. | 222/95 X |
| 3,260,421 | 7/1966 | Rabussier | 222/402.18 |
| 3,272,402 | 9/1966 | Frangos | 222/1 X |
| 3,471,059 | 10/1969 | Moller et al. | 222/95 |
| 3,731,854 | 5/1973 | Casey | 222/386.5 |
| 3,788,521 | 1/1974 | Laauwe | 222/94 |
| 3,938,708 | 2/1976 | Burger | 222/95 |

*Primary Examiner*—Robert B. Reeves
*Assistant Examiner*—David A. Scherbel

[57] ABSTRACT

An improved pressure package of the type having a generally rigid container, a liner within the container forming a reservoir containing a product to be dispensed under the influence of a propellant outside the reservoir and valve means closing the container wherein the improvement is the product has a first non-gaseous fluid phase and a second non-gaseous fluid phase, the phases being immiscible and having different densities to form a phase boundary within the reservoir, an orifice for communicating the first phase to the valve and a dip tube for communicating the second phase to the valve.

8 Claims, 13 Drawing Figures

PRESSURIZED CONTAINER FOR TWO-PHASE SYSTEM

BACKGROUND OF THE INVENTION

This invention relates to pressurized containers for dispensing two-phase systems. More particularly, this invention relates to pressurized containers for dispensing two-phase systems which include a deformable liner separating the propellant from the two-phase system to be dispensed.

In the last 15 years, aerosol containers have become widely used for dispensing a variety of products, such as laundry care products including pre-spotters and spray starches, personal care products including antiperspirants, perfumes, shaving creams and tooth pastes, a number of food products, furniture polishes, air fresheners and insecticides. Many times the active ingredients contained in these various formulations reacted adversely with the container, thereby necessitating special coatings on the inside of the container or special non-corrosive formulations which also often reduce the activity of the active ingredient.

For a number of product applications, two separate phases must be mixed and dispensed from an aerosol can. In the past, there have been a number of suggestions for dispensing a number of different phases, including U.S. Pat. Nos. 3,159,535; 3,148,127; 3,540,623 and Canadian Pat. No. 897,598.

Also, for a number of other products, such as various foods, it has often been desirable to separate the material to be dispensed from the propellant in order to avoid any potentially adverse interactions between the propellant and the product. With these types of products, a number of specialized containers, such as U.S. Pat. Nos. 3,731,854; 3,471,059; 3,423,818; 3,245,582 and 3,541,581 have been found useful. Also, in view of current ecological considerations relating to the release of fluorocarbon propellants into the atmosphere, it has also become desirable to determine and develop methods for dispensing systems previously primarily dependent upon fluorocarbon propellant systems, such as certain antiperspirant compositions, without releasing large amounts of fluorocarbon propellant to the atmosphere.

Lastly, it is most desirable to be able to formulate compositions for aerosol dispensing without regard to the effects of the container on the active ingredients, the propellant on the active ingredients and the active ingredients on the propellant and/or container.

Surprisingly, it has been found that an aerosol package suitable for dispensing a two-phase liquid system can be produced wherein the effects of the active ingredients on the container itself have been substantially eliminated.

BRIEF DESCRIPTION AND OBJECTS

The above result has been achieved by improving a pressure package of the type having a generally rigid container, a liner within the container forming a reservoir containing a product to be dispensed under the influence of a propellant outside the reservoir and valve means closing the container by means of providing the product with a first non-gaseous fluid phase and a second non-gaseous fluid phase, the phases being substantially immiscible and having different densities to form a phase boundry within the reservoir, first means for communicating the first phase to the valve and second means for communicating the second phase to the valve.

Accordingly, it is a primary object of the present invention to provide an improved aerosol pressurized package for dispensing two-phase liquid systems.

It is a further object of the present invention to provide an improved aerosol pressure package which can dispense compositions without regard to their corrosivity to conventional aerosol containers and without regard to the interaction of the composition with conventional propellants.

It is a still further object of the present invention to provide a pressurized aerosol package which enables a pressurized product to be dispensed in aerosol form without requiring the release of fluorocarbon propellants to the atmosphere.

BRIEF DESCRIPTION OF DRAWINGS

Still further objects and advantages of the pressurized package of the present invention will become more apparent from the following, more detailed description and from the attached drawings wherein.

Figure 1:
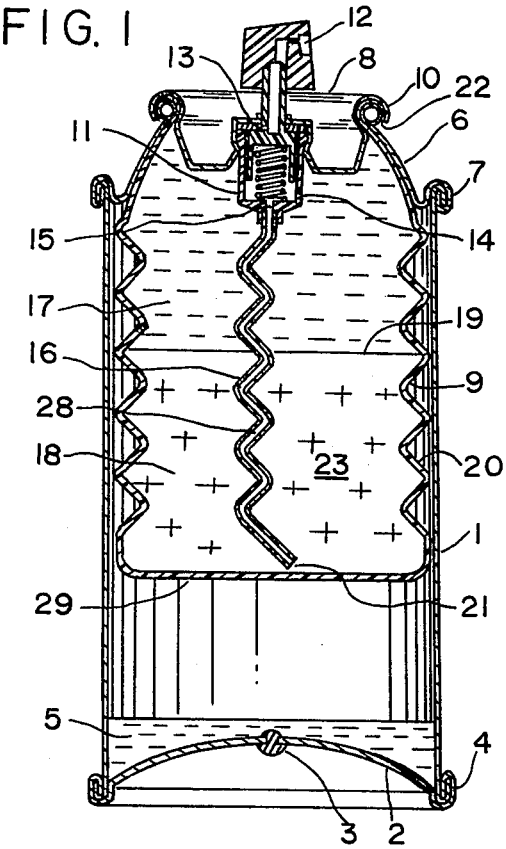
FIG. 1 is a side sectional diagrametic view of the pressurized package of the present invention.

In the attached drawings and in the following description thereof, a single reference numeral has been utilized to designate similar structures in different embodiments.

DETAILED DESCRIPTION OF INVENTION

As used in the instant specification and the appended claims, the term "non-gaseous fluid phase" means any fluid material sufficiently fluid to be dispensed from a pressurized package which is not a gas or a vapor at the conditions of pressure within the package. This term would include solutions, emulsions, liquid dispersions, colloids, suspensions and the like.

Referring now to FIG. 1 which shows one embodiment of the pressurized dispenser of the present invention, a generally rigid container body is provided having a cylindrical container wall 1, a bottom 2 sealingly and rigidly attached to the side wall 1 by means of a conventional double seam 4. Filling grommet 3 in an aperture in bottom 2 is utilized to fill propellant 5 in the container. Crown 6 is attached to the top end of side wall 1 by a double seam 7. The top of crown 6 has an opening which is closed by valve cup 8. Spaced within cylindrical wall 1 is a collapsible liner 9. Collapsible liner 9 is attached at its upper edge 22 to crown 6 and valve cup 8 by means of an outward curl 10 to form a reservoir 23 for receiving the product to be dispensed. Reservoir 23 is formed in such a manner that there is no communication between reservoir 23 and the chamber exterior of liner 9 containing propellant 5.

Seated in valve cup 8 is an aerosol valve means 11. Any conventional aerosol valve means can be used which, in conjunction with the first and second communicating means for the non-gaseous fluid phases, will mix or co-dispense the two phases maintained in the container. As an example, the aerosol valve means 11 shown in FIG. 1 includes a dispensing orifice 12, a stem orifice 13, a first product orifice 14 as the first means for communicating the first non-gaseous fluid phase to the valve means and a second product orifice 15. The second means for communicating the second non-gaseous fluid phase to the valve means in this embodiment comprises second product orifice 15 and dip tube 16 which is relatively flexible and attached to valve means 11. The interior central passage 28 of dip tube 16 allows communicating between second product orifice 15 and dip tube orifice 21. The relative sizes of the various orifices are a matter of choice depending on the type of product to be dispensed, the desired spray rate and the like and can be varied by those of ordinary skill in the aerosol dispensing art.

Contained in reservoir 23 are two non-gaseous fluid phases, 17 and 18. In order to be properly dispensed from the pressurized container of the present invention, phases 17 and 18 must be substantially immiscible with each other and have at least slightly different densities. This will insure a complete separation of upper phase 17 and lower phase 18 at phase boundry 19. Reservoir 23 must be substantially filled with product so that substantially no vapor space remains in reservoir 23. In the event during packaging that some space remains, upon actuation the package will remove this vapor space automatically. The absence of a vapor phase within reservoir 23 offers a number of advantages for certain products previously dispensed from aerosol containers, such as ability to formulate products containing no emulsifiers, a package which will dispense properly whether or not it is shaken and the ability to maintain two liquid phases substantially unmixed until dispensing.

The flexible liner 9, as shown in FIG. 1, has a relatively flat bottom 29 and horizontally pleated sides 20. The edge 22 of liner 9 can be fitted to be attached to the container wall either at double seam 7 or outward curl 10. If a material to be dispensed from liner 9 would be corrosive to container 1 or crown 6, of course, it would be desirable to attach liner 9 at outward curl 10 as opposed to double seam 7.

Figure 5:
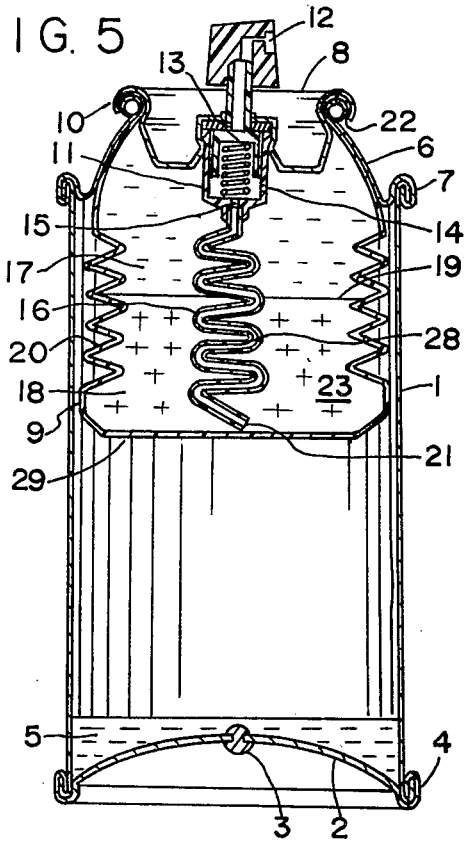
FIG. 5 is a view similar to FIG. 1 wherein the container has been partially emptied.

FIG. 5 shows a view of the container of FIG. 1 wherein approximately 50% of the product has been dispensed from the container. By examining FIG. 5, two important aspects of the pressurized container of the present invention will become immediately apparent. The first important aspect is that there is no headspace whatsoever within the interior of liner 9, the entire volume of reservoir 23 comprised of upper non-gaseous fluid phase 17 and lower non-gaseous fluid phase 18. Second, it is immediately apparent that dip tube 16 must be sufficiently flexible so as to be able to coil or bend upon itself under the pressure of propellant 5, as it acts upon liner 9 primarily through bottom 29, compressing pleated sides 20.

Figure 2:
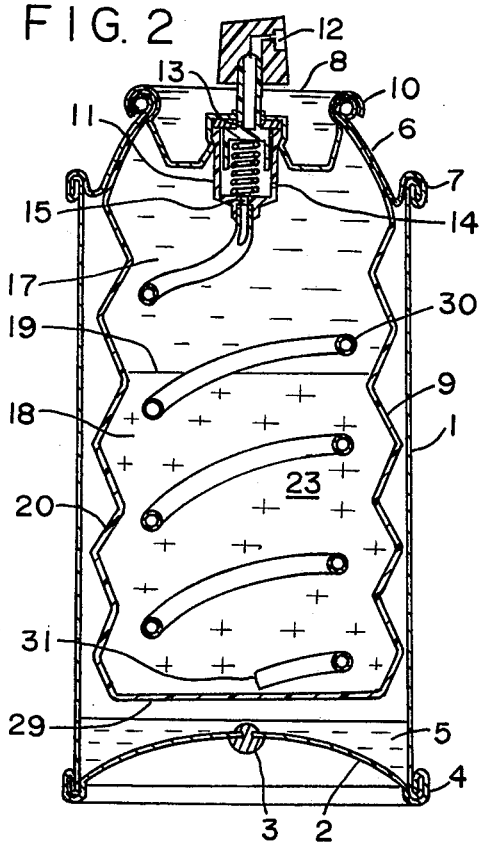
FIG. 2 is a side sectional diagrametic view of a further embodiment of the package of the present invention.

FIG. 2 shows a view of a second embodiment of the pressurized package of the present invention. In this embodiment, the dip tube 30 is prepared in such a manner so as to conform roughly to the inside shape of liner 9. This dip tube is coiled helically in relatively large helic coils, enabling the same to be readily and easily deformed under the pressure of propellant 5. With regard to dip tube construction, the most important aspect of the pressurized package of the present invention is a dip tube which is sufficiently rigid so that the orifice 31 of dip tube 30 is maintained in contact with lower phase 18 at all times. This also can be readily seen by referring to FIGS. 1 and 5 wherein orifice 21 is maintained in communication with lower phase 18 at all times.

Figure 3:
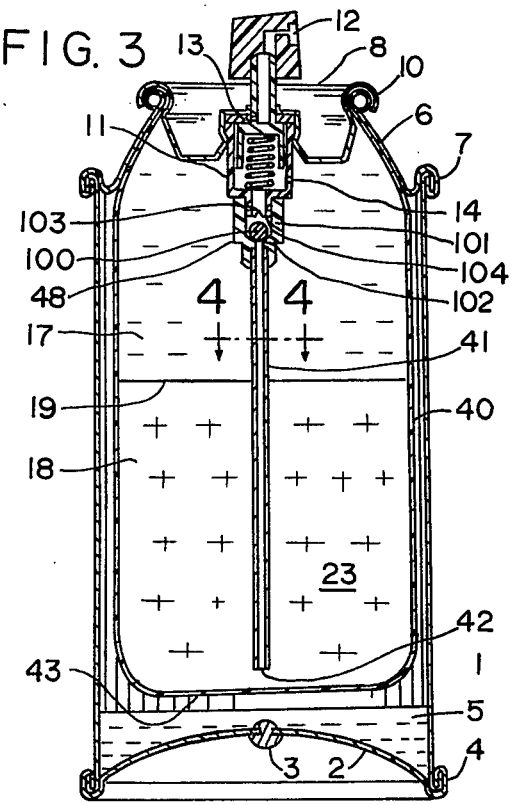
FIG. 3 is a side sectional diagrametic view of a still further embodiment of the present invention.
Figure 4A:
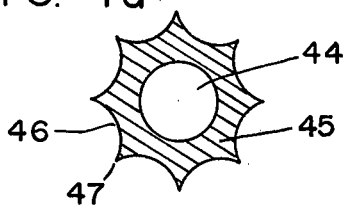
FIGS. 4*a* and 4*b* are alternative views taken along line 4—4 in FIG. 3.
Figure 4B:
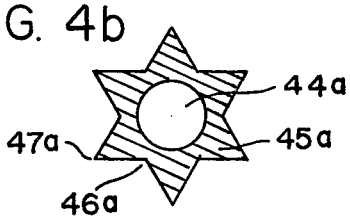

FIG. 3 shows a still further embodiment of the pressurized package of the present invention. In this embodiment, a substantially smooth sided liner 40 having no pleats whatsoever is disposed within container wall 1. Again, liner 40 can be attached either at double seam 7 or at outer curl 10 and can be made from any material which is sufficiently deformable under the pressure of propellant 5. Dip tube 41 is relatively rigid since liner 40 is able to deform toward dip tube 41 as shown in FIG. 6, which shows a diagrametic view of the container of FIG. 3 wherein a portion of the product has been dispensed.

Figure 6:
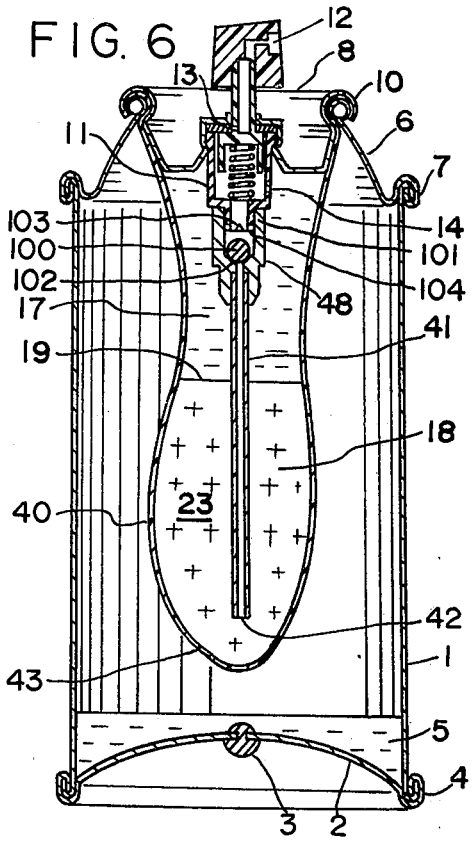
FIG. 6 is a view similar to FIG. 3 wherein the container has been partially emptied.

FIGS. 3 and 6 also show a modified valve which includes check valve means 48. Check valve means 48 can be any suitable means which will only allow the fluids to flow in the dip tube 41 toward valve means 11. The particular means shown in FIGS. 3 and 6 include a check ball 100, a check valve housing 101 which includes a generally concave valve seat 102 formed so that check ball 100 seals valve seat 102 when aerosol valve means 11 is closed. Housing 101 is attached to aerosol valve means 11 which includes a modified product orifice 103. Orifice 103 has a series of ridges 104 in the bottom of the side wall of aerosol valve means 11.

The dip tube 41 in this embodiment should have a concave cross-section similar to those embodiments shown in FIGS. **4*a* and 4*b*. The dip tubes have a central passage 44 and 44*a* within walls 45 and 45*a*. Walls 45 and 45*a* have a series of concave surfaces 46 and 46*a* joined by peaks 47 and 47*a*. Peaks 47 and 47*a* can be in any shape including angular as shown, rounded, flat or other more complex shapes. Although two specific cross-sections are shown in these figures, these, of course, should not be taken as limiting in any dip tube cross-section which would allow for communication between orifice 42 of dip tube 41 and the volume of the lower phase 18 in the event that liner 40 closed in and collapsed around dip tube 41 would be acceptable. Also, orifice 42 should be formed in such a manner so as to prevent the bottom of liner 41 from blocking the dip tube under the pressure of propellant 5**.

Figure 7:
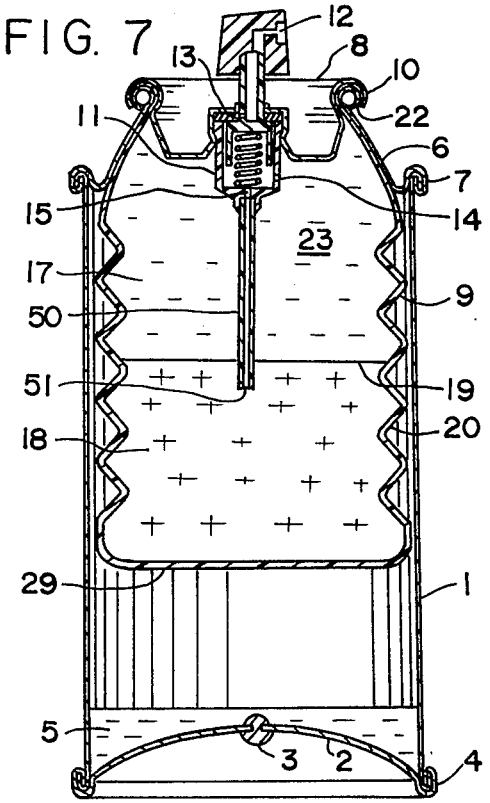
FIGS. 7, 8, 9 and 10 are views similar to FIG. 1 of still further embodiments of the present invention.

A still further embodiment of the pressurized package of the present invention is shown in FIG. 7 wherein a dip tube 50 having a lower orifice 51 is provided a container having a flexible liner 9. This flexible liner can either be of the type shown in FIG. 7 or can alternatively be of the type shown in FIGS. 3 and 6. Dip tube 50 should be sufficiently long so as to allow orifice 51 to be maintained below the upper level of lower phase 18 at all times. Dip tube 50, however, should be sufficiently flexible so that as the flexible liner 9 collapses around dip tube 50 as the product is dispensed dip tube 50 will be deformed under the pressure and allow complete dispensing of the products.

Figure 8:
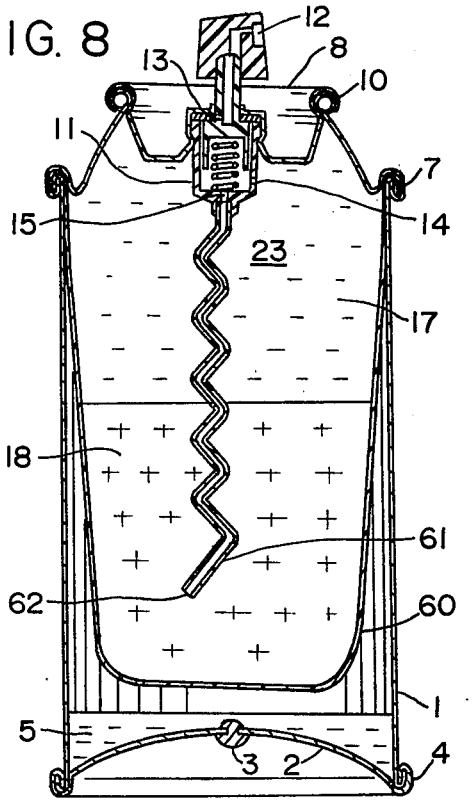

A still further embodiment is shown in FIG. 8 wherein flexible liner 60 having smooth sides is attached to double seam 7 instead of outward curl 10. Dip tube 61 has a helical or similar curl and provides sufficient communication to orifice 62 for lower phase 18 as liner 60 collapses.

Figure 9:
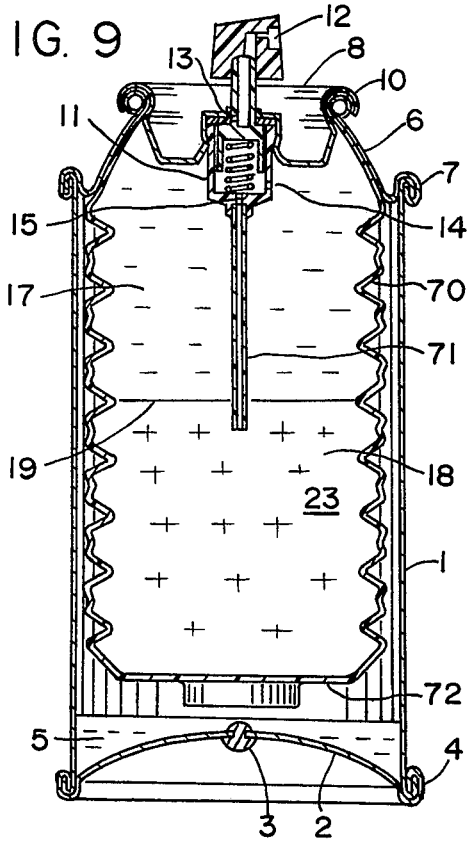

FIG. 9 shows a still further embodiment wherein liner 70 has a configuration as shown in U.S. Pat. No. 3,471,059, the disclosure of which is incorporated by reference. This liner will collapse upwardly under the influence of propellant 5. Dip tube 71 is shown as a shortened dip tube which is sufficiently rigid to collapse only under the influence of bottom 72 forced upward by propellant 5.

Figure 10:
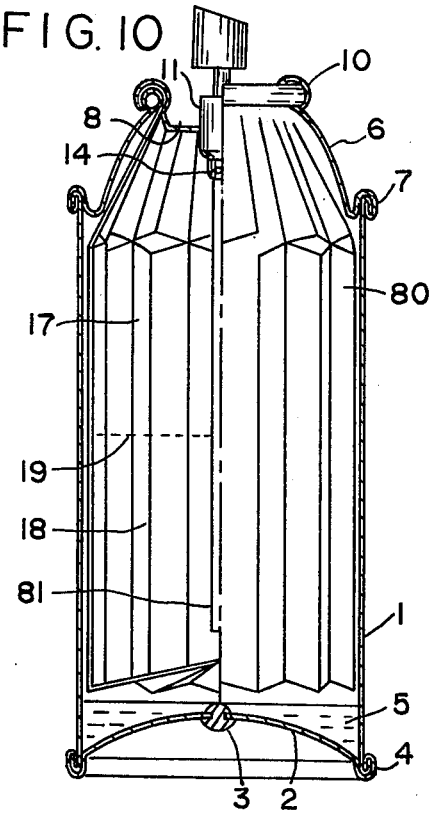

FIG. 10 shows a still further embodiment of the present invention wherein liner 80 has a configuration as shown in U.S. Pat. No. 3,731,854, the disclosure of which is herein incorporated by reference. The liner has vertical pleats and collapses in an axial or horizontal direction around dip tube 81. Dip tube 81 can be any standard dip tube and need not be flexible. Aerosol valve means 11 has a first product orifice 14 as in FIG. 1 so that upper phase 17 is dispensed through this orifice and lower liquid phase 18 is dispensed through dip tube 81 and mixed in aerosol valve means 11.

Figure 11:
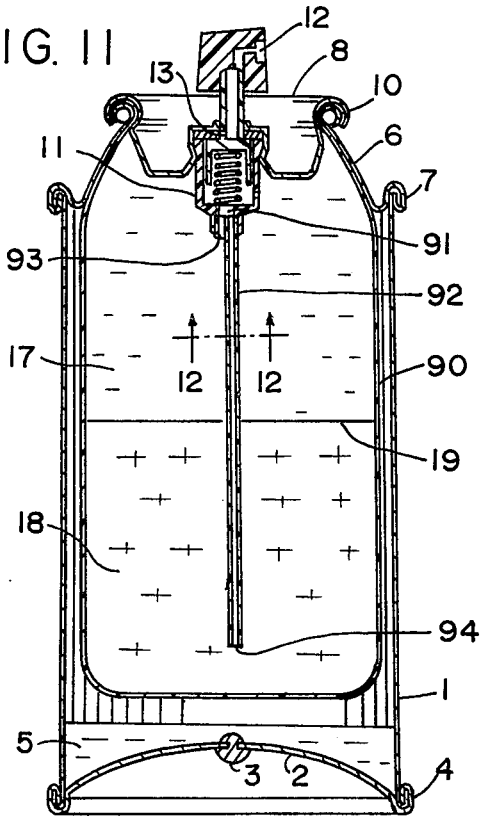
FIG. 11 is a partial side sectional view of an alternative embodiment using a modified valve and dip tube.

FIG. 11 shows a further embodiment of the present invention wherein a modified dip tube arrangement has been utilized. Liner 90 is shown as a smooth side liner; however, any type of liner, such as those described previously, could also be utilized. Aerosol valve means 11 has one single product orifice 91. In this orifice the first and second means for communicating the first and second phases respectively is a dual dip tube 92 having a first product orifice 93 for upper phase 17 and a second orifice 94 for lower phase 18.

Figure 12:
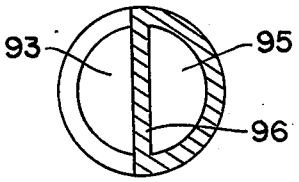
FIG. 12 is a view along line 12—12 in FIG. 11.

FIG. 12 shows a view along line 12—12 in FIG. 11 and clearly shows first product orifice 93. Also shown is central passage 95 communicating with second product orifice 94 and valve means orifice 91. As is seen from FIG. 12, central passage 95 is separated from the passage communicating orifice 93 and orifice 91 (not shown) by center wall 96 in dip tube 92. Although only two embodiments of the means for communicating the respective phases from the reservoir to the valve areas have been shown, it would be immediately apparent to other persons of ordinary skill in the art that other similar embodiments to those shown in FIGS. 1 and 11 could also be used.

Propellant 5, utilized to dispense the product contained in reservoir 23 in the pressure packages of the present invention, and can be any conventional composition, such as halogenated hydrocarbons and hydrocarbons. Suitable halogenated hydrocarbons include one or more of the following compounds and mixtures to obtain the desired pressure upon the liners utilized in the present invention: trichlorofluoromethane, dichlorodifluoromethane, dichlorofluoromethane, fluorodifluoromethane, trichlorotrifluoroethane, dichlorotetrafluoroethane, 1-1-difluoroethane, fluorodichloroethane, and octafluorocyclobutane. Suitable hydrocarbon propellants include propane, normal butane, isobutane, normal pentane, isopentane and normal hexane. Although the above noted compounds have all been designated as propellants, in actuality some of these materials are utilized as the active propellant while other materials have lower pressure and are used as diluents to control the pressure within the aerosol package to the predetermined desired pressure. However, such control utilizing combinations of propellant compounds is well within the skill of a person of ordinary skill in the art.

Within reservoir 23, a number of different compositions can be dispensed. Any compositions can be dispensed so long as they have two immiscible phases having different densities, such as a liquid having a high vapor pressure and an aqueous emulsion solution of an active ingredient, such as perfume, insecticide, germicide, antiperspirant, hair spray and the like. Since there is no air space within reservoir 23, the difference in density need not be particularly great since there is no means available to intermix the different phases. As an example of one composition which can be dispensed from the package of the present invention is an antiperspirant composition wherein the lower phase would comprise an aqueous solution of an astringent, such as aluminum chloride, aluminum chlorhydroxide, while the upper phase is a liquid having a high vapor pressure, such as liquid isobutane, which aids in producing a very fine spray and aids in breaking up the lower aqueous phase. For an antiperspirant composition, the weight ratio of lower aqueous phase to upper liquid phase ranges from 1:20 to 20:1, and preferably 1:5 to 10:1 and most preferably 1:1 to 10:1. Spray rates and particle size, of course, can be greatly varied by changing the orifice size for the respective product orifices and also by changing the outlet orifice of valve means 11. Additionally, mechanical break-up means, such as are commonly used in the art, also can be employed. A primary advantage of utilizing the aerosol package system of the present invention with an antiperspirant composition is that aluminum chlorhydroxide in combination with water has a degree of corrosivity to standard aerosol packages requiring special formulations and/or coatings on the interior of these packages. Since aluminum chlorhydroxide is activated primarily by water, the effectiveness of an antiperspirant composition delivered utilizing the propellant package of the present invention is enhanced over those conventionally delivered utilizing oily emmolients, such as isopropyl myristate.

Other types of products can also be dispensed utilizing the package of the present invention, the only requirement being that the product to be dispensed consist of two non-gaseous fluid phases which are substantially immiscible and have different densities.

The liners used in the present invention can be formed from any flexible material which does not adversely react with either the product in reservoir 23 or with the propellant and which is substantially impermable to the particular propellant used.

While the present invention has been illustrated and described with reference to the foregoing specific disclosure and figures and embodiments, the invention is in no way to be limited thereto, but should include any and all reasonable and obvious equivalents and alternatives to those means as described. The present invention shall only be limited by way of the following appended claims.

What is claimed is:

1. In a pressure package of the type having:

a generally rigid container, a liner within said container forming a reservoir containing a product to be dispensed under the influence of a propellant outside said reservoir said propellant being contained in a closed chamber; and valve means closing said container, said valve means defining first and second orifices in communication with said reservoir and wherein said first communicating means is said first orifice and said second communicating means includes said second orifice;

the improvement which comprises said product having a first non-gaseous fluid phase and a second non-gaseous fluid phase, said phases being substantially immiscible and having different densities to form a phase boundry within said reservoir, said first phase having a lower density than said second phase, first means for communicating said first phase to said valve; and second means for communicating said second phase to said valve, said second communicating means including a dip tube which extends below said phase boundry said dip tube being sufficiently flexible to be deformed by the contraction of said liner under the influence of said propellant, said first and second communicating means being independent so that said first phase and said second phase remain substantially unmixed until said phases are delivered by said communicating means to said valve means.

2. The package of claim 1 wherein said dip tube has a helical coil.

3. The package of claim 1 wherein said liner has a relatively flat bottom and sides having a series of horizontal pleats.

4. The package of claim 1 which includes check valve means between said second orifice and said dip tube.

5. The package of claim 1 wherein said first phase is a propellant and said second phase is an aqueous solution of an active ingredient.

6. The package of claim 5 wherein said first phase is liquid isobutane and said second phase is an aqueous solution of an astringent.

7. The package of claim 6 wherein said astringent is aluminum chlorhydroxide.

8. The package of claim 5 wherein the weight ratio of said second phase to said first phase is 1:20 to 20:1.

* * * * *